US006976439B2

(12) United States Patent
Uchida

(10) Patent No.: US 6,976,439 B2
(45) Date of Patent: Dec. 20, 2005

(54) INCINERATOR

(75) Inventor: Yotaro Uchida, Kokubunji (JP)

(73) Assignee: Sanyo Industries Co., Ltd., Tokyo (JP)

( * ) Notice: Subject to any disclaimer, the term of this patent is extended or adjusted under 35 U.S.C. 154(b) by 0 days.

(21) Appl. No.: 10/507,338

(22) PCT Filed: Jan. 16, 2003

(86) PCT No.: PCT/JP03/00323

§ 371 (c)(1),
(2), (4) Date: Sep. 10, 2004

(87) PCT Pub. No.: WO03/076847

PCT Pub. Date: Sep. 18, 2003

(65) Prior Publication Data

US 2005/0126453 A1 Jun. 16, 2005

(30) Foreign Application Priority Data

Mar. 12, 2002 (JP) ..... 2002-066497

(51) Int. Cl.[7] ..... F23L 7/00; F23L 15/00

(52) U.S. Cl. ..... 110/306; 110/308; 110/302; 110/303

(58) Field of Search ..... 110/306, 308, 297, 110/301, 302, 314, 348, 150, 157, 251, 213

(56) References Cited

U.S. PATENT DOCUMENTS 754,151 A * 3/1904 Lewis ..... 110/306
1,721,782 A * 7/1929 Huwyler ..... 110/306
6,321,665 B1 * 11/2001 Uchida ..... 110/235

FOREIGN PATENT DOCUMENTS

JP 11-282888 * 4/2001

* cited by examiner

*Primary Examiner*—Kenneth Rinehart
(74) *Attorney, Agent, or Firm*—Diller, Ramik & Wight

(57) ABSTRACT

An incinerator (10) comprising a combustion chamber (11) and a plurality of combustion-promoting fluid blast pipes (19) disposed so as to project from one location on the inner wall (12) of the combustion chamber, extend in that vertical direction and exit to the exterior from another location, wherein the combustion-promoting fluid blast pipes (19) are of a triple-pipe construction, composed of an air-supply pipe (20*a*), a steam/gas-supply pipe 20*b* provided outside thereof which supplies steam or combustible gas, and a water pipe which is provided further outside thereof, and nozzles (21), which are formed on these combustion-promoting fluid blast pipes (19), are formed in a position facing in one circumferential direction of the combustion chamber (11) so that a combustion-promoting fluid blown out from these nozzles forms a swirling flow within the combustion chamber (11).

7 Claims, 3 Drawing Sheets

INCINERATOR

TECHNICAL FIELD

The present invention relates to an incinerator, and more particularly to an incinerator which incinerates industrial waste and other varieties of waste, for example.

BACKGROUND ART

In the incineration of industrial waste and other varieties of waste, the generation of dioxin, a toxic substance, is becoming a big social problem. As a conventional incinerator for industrial waste and the like, the incinerator described in Japanese Patent Application Laid-Open No. 2001-108221 is known. This conventional incinerator provides a cylindrical combustion chamber in the incinerator main body. Within this combustion chamber, a plurality of air-supply pipes, which are formed in a U-shape with two horizontal portions, upper and lower, and one vertical portion, are provided to project toward the center of the incinerator. A lateral section of one of the upper and lower horizontal portion of each of the air-supply pipes is provided with a plurality of air nozzles, through which a high-pressure, high-temperature air is blown out in the circumferential direction of the combustion chamber. A swirling flow is generated within the combustion chamber by blowing out high-pressure, high-temperature air in the circumferential direction of the combustion chamber together with supplying oxygen, so that combustion efficiency is raised and also the generation of non-combusted components is curbed.

However, in the conventional incinerator, combustion efficiency was not sufficiently high and the generation of non-combusted components was detected. Therefore, the development of an incinerator of an even higher efficiency had been hoped for.

In order to resolve the conventional problems, the present invention have been made and an object of the present invention is to provide a high-performance incinerator capable of raising combustion efficiency for various wastes and curbing as much as possible the generation of non-combusted components and the like.

DISCLOSURE OF THE INVENTION

An incinerator of the present invention comprises a cylindrical combustion chamber; and a plurality of combustion-promoting blast pipes each of which is disposed so as to project from one location on an inner wall of the combustion chamber, extend in a vertical direction thereof and exit to exterior from another location, wherein the combustion-promoting fluid blast pipes are of a triple-pipe construction, comprising an air-supply pipe, a steam/gas-supply pipe which is provided concentrically outside of the air-supply pipe for supplying steam or combustible gas, and a water pipe which is provided concentrically further outside thereof for protecting the air-supply pipe and the steam/gas-supply pipe from heat, a plurality of nozzles being provided on each of the combustion-promoting fluid blast pipes, and the nozzles being positioned facing in one circumferential direction of the combustion chamber so that a combustion-promoting fluid blown out from the combustion-promoting fluid blast pipes forms a swirling flow within the combustion chamber; and the air-supply pipes and the steam/gas-supply pipes in the combustion-promoting fluid blast pipes are connected respectively to a high-pressure air-supply source and a steam/gas-supply source, so that air and either steam or combustible gas or both can be blown from each of the supply sources into the combustion chamber as the combustion-promoting fluid via the combustion-promoting fluid blast pipes.

Also, the incinerator of the present invention comprises a cylindrical combustion chamber; and a plurality of combustion-promoting blast pipes each of which is disposed so as to project from an inner wall of the combustion chamber and extend in a vertical direction thereof, wherein the combustion-promoting fluid blast pipes are of a quadruple-pipe construction, comprising an air-supply pipe, a steam-supply pipe which is provided concentrically outside of the air-supply pipe, a combustible-gas supply pipe provided concentrically outside of the steam-supply pipe, and a water pipe which is provided concentrically further outside thereof for protecting the air-supply pipe, the steam-supply pipe and the combustible-gas supply pipe from heat, a plurality of nozzles being provided on each of the combustion-promoting fluid blast pipes, the nozzles being positioned facing in one circumferential direction of the combustion chamber so that a combustion-promoting fluid blown out from the combustion-promoting fluid blast pipes forms a swirling flow within the combustion chamber; and the air-supply pipes, the steam-supply pipes and the combustible-gas-supply pipes in the combustion-promoting fluid blast pipes are connected respectively to a high-pressure air-supply source, a steam-supply source and a combustible-gas supply source, so that steam and combustible gas can be selectively blown from each of the supply sources air into the combustion chamber as the combustion-promoting fluid via the combustion-promoting fluid blast pipes.

Further, in the incinerator of the present invention, in addition to the above-mentioned features, the combustion-promoting fluid blast pipes provided within the combustion chamber may project from the inner wall of the combustion chamber in a radial direction. As another installation manner of the combustion-promoting fluid blast pipes, they may be disposed on respective sides of a hypothetical polygon inscribed in the combustion chamber when the combustion chamber is viewed in a transverse cross section. In this installation manner, it is preferable that the hypothetical polygon inscribed in the combustion chamber is a regular tetragon, which defines the installation position of the combustion-promoting fluid blast pipes.

BEST MODE FOR CARRYING OUT THE INVENTION

Figure 1:
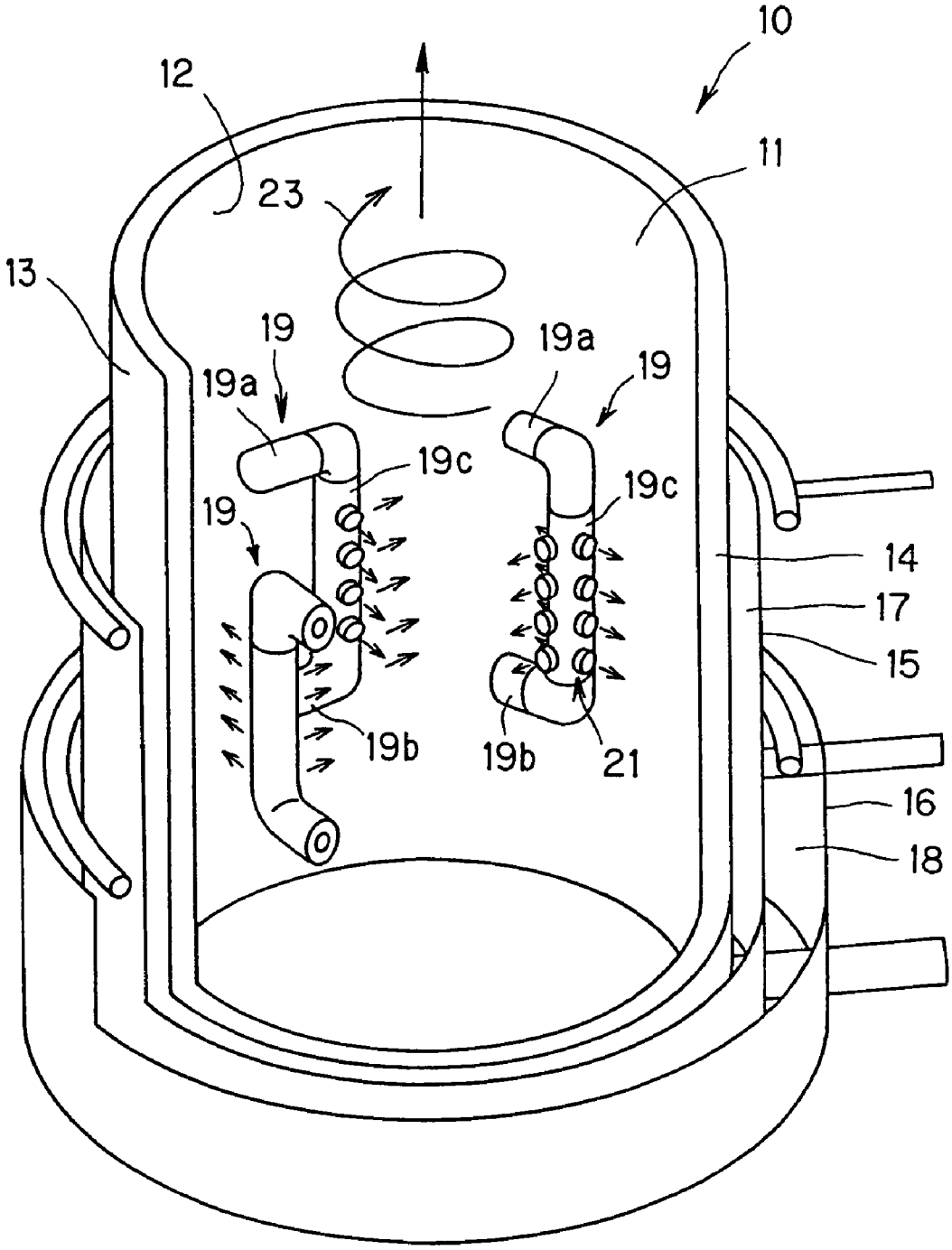
FIG. 1 is a perspective view schematically illustrating principal components of an incinerator according to one embodiment of the present invention.

Following, an embodiment of an incinerator of the present invention as shown in the drawings will be explained in more detail. In FIG. 1, the lower section of an incinerator 10 according to one embodiment of the present invention is shown as a principal component. This incinerator 10 comprises a cylindrical combustion chamber 11 formed therein by an inner wall 12. On the outside of the inner wall 12 an outer wall 13 is provided. A water jacket 14 is formed between the inner wall 12 and the outer wall 13.

In the lower side from the intermediate vicinity in the vertical direction in this incinerator 10, a jacket compartment wall 15 is provided which encloses the perimeter of this outer wall 13. Another jacket compartment wall 16 is provided further outside thereof. The jacket formed by the outer wall 13 and the jacket compartment wall 15 forms a steam/gas chamber 17, which houses a gas having a high vaporization temperature such as PCB or the like, or steam, or a mixed fluid thereof, and the jacket further outside thereof forms an air chamber 18.

Figure 2:
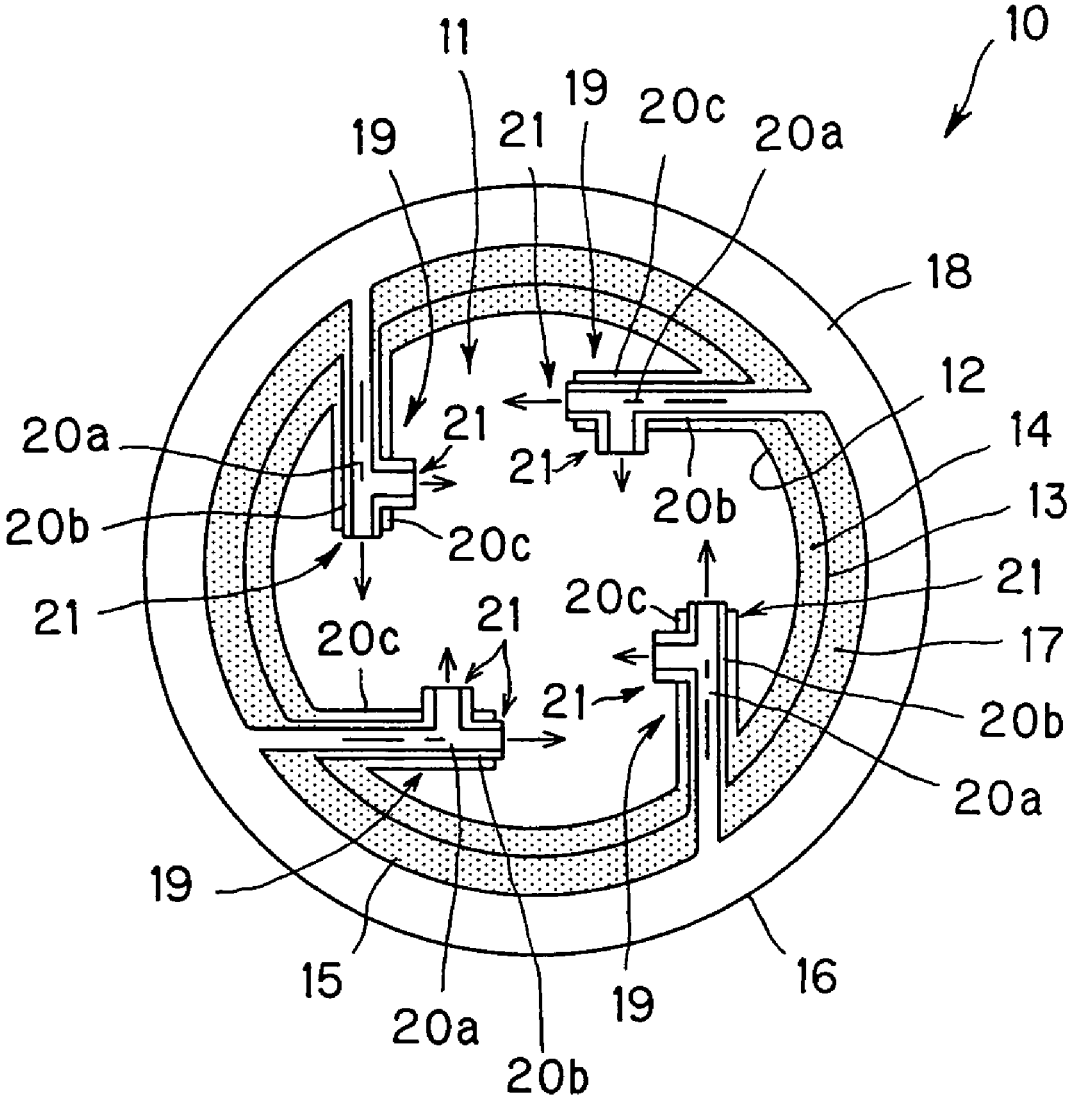
FIG. 2 is a transverse cross section of the incinerator shown in FIG. 1.

In the combustion chamber 11 of this incinerator 10, as is shown in FIG. 1 and FIG. 2, four combustion-promoting fluid blast pipes 19 are installed. These combustion-promoting fluid blast pipes 19 are provided in an approximate U-shape by a horizontal pipe portion 19*a* which projects approximately horizontally from one part of the wall section demarcating the combustion chamber 11, a vertical pipe portion 19*c* which extends in the vertical direction of the combustion chamber 11, and a horizontal pipe portion 19*b* which exits to the exterior from another part of the wall section.

Figure 3:
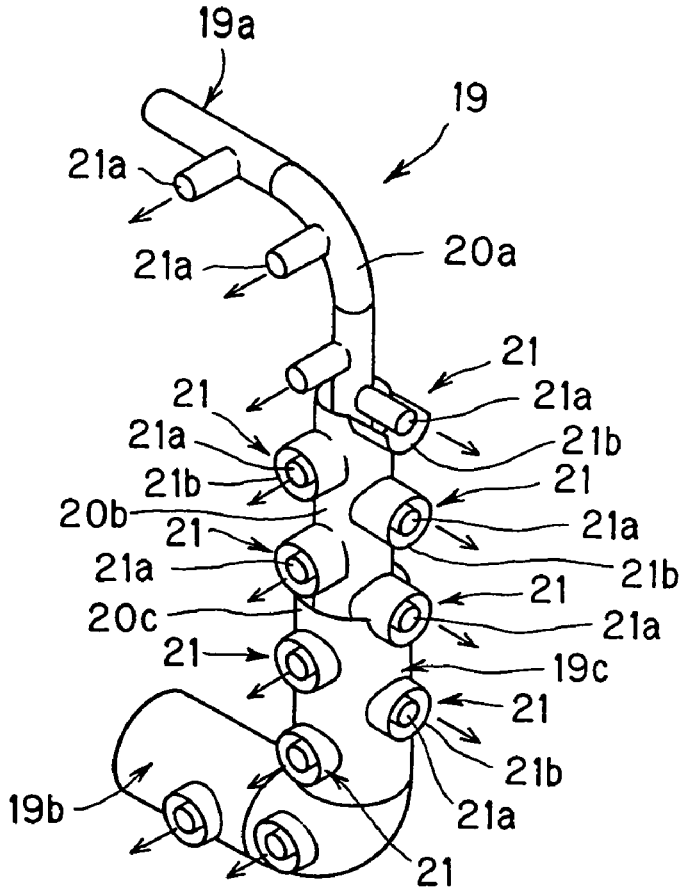
FIG. 3 is a partly broken perspective view illustrating a combustion-promoting fluid blast pipe which is installed in the combustion chamber of the incinerator shown in FIG. 1.

The installation mode of these combustion-promoting fluid blast pipes 19 is now explained in more detail. As is clear from FIG. 2, which shows the combustion chamber 11 viewed in a cross section, the combustion-promoting fluid blast pipes 19 are installed within the combustion chamber 11 so as to be positioned on respective sides of a hypothetical regular tetragon inscribed in the combustion chamber 11. Each of these combustion-promoting fluid blast pipes 19 is of a triple-pipe construction. To explain this point more specifically, as shown in FIG. 3, each combustion-promoting fluid blast pipe 19 has an air-supply pipe 20*a* disposed in the innermost side, a steam/gas-supply pipe disposed concentrically outside thereof, and a water pipe 20*c* disposed concentrically further outside thereof.

The air-supply pipe 20*a* of the innermost side, as is clear from FIG. 2, communicates with the air chamber 18, and the steam/gas-supply pipe 20*b* outside thereof communicates with the steam/gas chamber 17, and the outermost water pipe 20*c* is in communication with the water jacket 14. The water jacket 14 of the incinerator 10 is in communication with a water-supply source, not shown, and furthermore this water jacket 14 is connected with the steam/gas chamber 17 by a communication pipe, via a steam heater (not shown) provided in the upper section of the combustion chamber 11.

As a result, when water within the water jacket 14 is vaporized by the combustion heat in the combustion chamber 11, that water vapor is heated further by the heater provided in the upper section of the combustion chamber 11 and becomes high-temperature water vapor, and is guided to the steam/gas chamber 17 outside thereof by the communication pipe. A first switching valve (not shown) is provided on the communication pipe supplying high-temperature water vapor from the steam heater to the steam/gas chamber 17, and by controlling this first switching valve a supply of steam can be received, or alternatively the supply of steam can be suspended. Naturally, the communication pipe is constructed so that in a case where the first switching valve is closed, a safety valve such as a relief valve operates concurrently.

Furthermore, this steam/gas chamber 17 is also connected to a polychlorinated biphenyl (PCB)-supply source, not shown, by a communication pipe. Specifically, the PCB-supply source is connected by a communication pipe to a downstream passage section of a PCB heater installed within the combustion chamber 11, and the upstream passage section of this PCB heater is in communication with the steam/gas chamber 17 by a communication pipe. A second switching valve (not shown) is installed on the communication pipe which sends PCB from the PCB-supply source to the PCB heater, and by controlling this second switching valve PCB can be supplied or alternatively, the supply can be suspended.

The PCB sent from the PCB-supply source to the PCB heater is heated and vaporized (gasified) by the combustion heat within the combustion chamber 11. PCB vaporizes at approximately 603–648 degrees Celsius, to become a combustible gas. A combustible gas of vaporized PCB is supplied to the steam/gas chamber 17 and is mixed with water vapor, or taken in alone. The PCB gas that has been taken into the steam/gas chamber 17 mixed with water vapor or alone is blown out into the combustion chamber 11 via the combustion-promoting fluid blast pipes 19, together with high-temperature, high-pressure air.

Conventionally, PCB has been burnt at a high temperature of approximately 1,200 degrees Celsius, and has incurred expenses such as fuel costs and electricity costs. However, in the incinerator 10 which incinerates industrial waste and the like in the way as described above, when the combustion heat which develops within the combustion chamber 11 is utilized to heat and vaporize the PCB, the PCB can be burnt as a fuel even at low temperatures, and furthermore, dioxin and other toxic substances do not develop during incineration. Therefore, an extremely advantageous and economical processing method is provided by the present invention.

Moreover, the air chamber 18 is in communication with a high-pressure air-supply source, not shown, and is supplied with high-pressure air from this high-pressure air-supply source. In so doing, the high-pressure air supplied from the high-pressure air-supply source is sent to an air-heating device (not shown) installed within the upper part of the combustion chamber 11, and after being heated therein is supplied to the air chamber 18.

In the four combustion-promoting fluid blast pipes 19 provided inside the combustion chamber 11, principally on the vertical pipe portion 19*c*, as is clear from FIG. 2 and FIG. 3, a plurality of combustion-promoting fluid nozzles 21 is provided formed in a line with each oriented in a circumferential direction, in positions closer to the core and positions closer to the inner wall 12. Each combustion-promoting fluid nozzle 21 has an air nozzle 21*a* disposed in the center, and a steam/gas-supply nozzle 21*b* disposed concentrically outside thereof.

As is shown in FIG. 2, the air nozzle 21*a* of the central side is provided so as to communicate with the air-supply pipe 20*a*, and the ring-shaped steam/gas nozzle 21*b* outside thereof is provided so as to communicate with the gas/steam supply pipe 20*b*. At the front of each of the combustion-promoting fluid nozzles 21, in which the air nozzles 21*a* and the steam/gas nozzles 21*b* are concentrically provided, a cap 22 is fitted.

Figure 4:
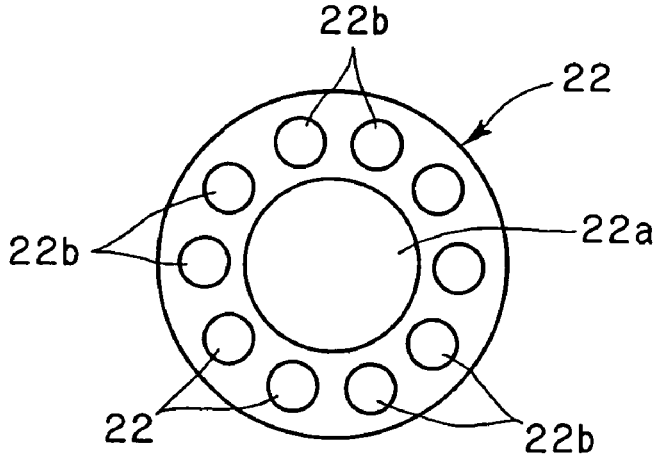
FIG. 4 is a front view illustrating a cap which covers the combustion-promoting nozzle of the combustion-promoting blast pipe shown in FIG. 3.

This cap 22, as shown in FIG. 4, is provided in the central section thereof with a circular opening 22*a* having the same diameter as the air nozzle 21*a*, and on the perimeter of this circular opening 22*a*, namely, in the annular section blocking steam/gas nozzle 21*b*, a multiplicity of circular openings 22*b* is provided in a line, equidistantly spaced.

As a result, the combustion-promoting fluid, consisting of high-pressure, high-temperature air and PCB gas or steam or a mixed fluid thereof, which is blown out from each of the combustion-promoting fluid nozzles 21 of each of the combustion-promoting fluid blast pipes 19, mixes evenly immediately after being blown out because the high-pressure, high-temperature air is blown out from the opening 22*a* in the central section of the cap 22 and the PCB gas or steam or mixed fluid thereof is blown out from the plurality of openings 22*b* on the perimeter thereof.

Moreover, the combustion promoting fluid which is blown out from each of the combustion-promoting fluid nozzles 21 of the combustion-promoting fluid blast pipes 19, which face in the circumferential direction of the combustion chamber 11 and are adjacent to the inner wall 12 therein, generates a swirling flow within the combustion chamber 11, as is illustrated by the arrow 23 in FIG. 1. The blowing out of the combustion-promoting fluid to form a swirling flow in this way, becomes one major factor facilitating the incineration of industrial and other varieties of waste.

Next, the operation of this incinerator will be explained.

Industrial and other varieties of waste are introduced into the combustion chamber 11 from a feeding port in the same way as conventional incinerators. From the central air nozzle 21*a* in each of the combustion-promoting fluid nozzles 21 on each of the triple-constructed combustion-promoting fluid blast pipes 19 which protrude within the combustion chamber 11, as mentioned previously, high-pressure, high-temperature air which has been heated is fed into the combustion chamber 11. Furthermore, from the steam/gas nozzle 21*b* in each of the combustion-promoting fluid nozzles 21, PCB gas, or steam, or a mixed fluid thereof is fed into the combustion chamber 11.

The high-pressure, high-temperature air which is blown out from the air nozzles 21*a* via the air-supply pipe 20*a* is heated by the air-heating pipe in the upper section of the combustion chamber 11, and so does not bring about a reduction in the furnace temperature when supplied to the combustion chamber 11. As previously mentioned, the combustion-promoting fluid blown out from each of the combustion-promoting fluid nozzles 21 becomes a large vortex swirling in the entire combustion chamber 11, so that the combustion effect is markedly improved.

Moreover, water vapor is heated by the steam heater provided in the upper section of the combustion chamber 11, and when this is blown out into the combustion chamber 11 from the combustion-promoting fluid nozzles 21 together with the high-pressure, high-temperature air, the combustion effect can be increased with the action of the water vapor. Namely, by mixing water vapor in the high-pressure, high-temperature air blown out from the air-supply pipe 20*a*, combustibility increases, and combustion is promoted further.

In other words, high-pressure, high-temperature air is supplied to the combustion chamber 11 in order to utilize the oxygen contained in air in a proportion of a little less than 21%, as a combustion improver, while the oxygen content of steam vapor, namely water, is a little more than 33%. Accordingly, a better combustion efficiency is achieved burning materials by supplying water, with an oxygen content of a little more than 33%, than by burning materials using air, with an oxygen content of a little less than 21%. Obviously, water itself will not burn in a normal state, and is required to be burnt under high-temperature conditions which separate the water into hydrogen and oxygen. However, even if burning with steam is recognized as providing a better combustion efficiency, because steam does not develop from immediately after the inception of combustion, it is necessary to supply high-pressure, high-temperature air simultaneously.

Accordingly, by adjusting the amounts of high-pressure, high-temperature air and heated water vapor supplied and striking a suitable balance, the optimal combustion efficiency can be obtained. In this respect, in this incinerator 10, control devices are employed so that the supply of air to the combustion chamber 11, and the supply to the combustion chamber 11 of either combustible gas or steam or both to the combustion chamber 11 are conducted separately, and therefore high-pressure, high-temperature air and heated water vapor can be supplied to the combustion chamber 11 in desirably balanced quantities.

In other words, in this incinerator 10, supplying only high-pressure, high-temperature air, supplying only steam, supplying only combustible (PCB) gas, or supplying an appropriate combination thereof to the combustion chamber 11 is made all possible. As a result, as mentioned previously, combustion efficiency can be increased by elevating the furnace temperature to a high temperature easily, or phrased differently, by controlling the furnace temperature at a high temperature easily.

Specifically, even a material with a water content above 20%, for example, which could not be incinerated in conventional incinerators due to bringing about a reduction in furnace temperature, can be incinerated almost completely if incinerated in this incinerator 10. Furthermore, for a material which requires a large quantity of oxygen to be incinerated, the combustion effect can be markedly heightened by supplying a mixed fluid of steam and high-pressure, high-temperature air to the combustion chamber 11.

Additionally, in this incinerator 10, due to a unique construction which gives protection to the air-supply pipe 20*a* and the steam/gas-supply pipe 20*b* with the water pipe 20*c*, and also gives protection to the water pipe 20*c* itself with the water flowing inside thereof from extreme temperature increases, there is no occurrence of heat degradation whatsoever, and accordingly there is no damage caused by the impact of introducing industrial and other varieties of waste.

In the above-mentioned embodiment of the incinerator 10, when the combustion chamber 11 is viewed in a transverse cross section, the combustion-promoting fluid blast pipes 19 are installed within this combustion chamber 11 so as to be positioned on the respective sides of a regular tetragon inscribed therein. However, the present invention is not limited to this mode of arrangement and it is also acceptable to position the combustion-promoting fluid blast pipes 19 to as to project radially from the wall of the incinerator, as in conventional incinerators.

Moreover, in the above-mentioned embodiment of the incinerator 10, the combustion-promoting fluid blast pipes 19 are given a triple-pipe construction. However, a quadruple-pipe construction is also desirable. Namely, each of the combustion-promoting fluid blast pipes 19 may be constituted by an air-supply pipe disposed in the innermost side, a steam-supply pipe disposed outside thereof, a PCB gas (combustible gas)-supply pipe disposed further outside thereof, and a water pipe on the outermost side. In this case, a part of the water jacket 14 in the incinerator 10 according to the above-mentioned embodiment is further divided into two jackets, and the inner jacket is made exclusively for PCB gas, and the jacket outside thereof is made exclusively for water.

In the above-mentioned embodiment of the present invention, a case of incinerating industrial and other varieties of waste was explained, but the present invention is not limited to this, and obviously may be applied to the incineration of all materials, so far as the materials can be incinerated.

As explained above, according to an incinerator of the present invention, combustion-promoting fluid blast pipes of a triple-pipe construction or a quadruple-pipe construction are provided inside the combustion chamber, and by making it possible to blow out a combustion-promoting fluid consisting of air and either steam or combustible gas or both from these combustion-promoting fluid blast pipes so that a swirling flow develops within the combustion chamber, whereby not only can combustion efficiency be increased when waste and the like is incinerated for example, but the generation of harmful gases can also be contained, and processing capacity can be raised markedly.

Also, mechanisms for separating or neutralizing harmful gases become unnecessary and an incinerator of the present invention can be offered at an extremely low price and of course with reduced running costs.

INDUSTRIAL APPLICABILITY

As explained above, an incinerator of the present invention is suitable as an incinerator that, when industrial and other varieties of waste are incinerated, increases combustion efficiency while controlling the generation of harmful gases, and furthermore, markedly increases the processing capacity.

What is claimed is:

1. An incinerator comprising:

a cylindrical combustion chamber; and a plurality of combustion-promoting blast pipes each of which is disposed so as to project from one location on an inner wall of the combustion chamber, extend in a vertical direction thereof and exit to exterior from another location, wherein the combustion-promoting fluid blast pipes are of a triple-pipe construction, each comprising an air-supply pipe, a steam/gas-supply pipe which is provided concentrically outside of the air-supply pipe for supplying steam or combustible gas, and a water pipe which is provided concentrically further outside thereof for protecting the air-supply pipe and the steam/gas-supply pipe from heat, and a plurality of nozzles are provided on each of the combustion-promoting fluid blast pipes, the nozzles being positioned facing in one circumferential direction of the combustion chamber so that a combustion-promoting fluid blown out from the combustion-promoting fluid blast pipes forms a swirling flow within the combustion chamber; and the air-supply pipes and the steam/gas-supply pipes in the combustion-promoting fluid blast pipes are connected respectively to a high-pressure air-supply source and a steam/gas-supply source, so that air and either steam or combustible gas or both can be blown from each of the supply sources into the combustion chamber as the combustion-promoting fluid via the combustion-promoting fluid blast pipes.

2. The incinerator as claimed in claim 1, wherein the combustion-promoting fluid blast pipes provided within the combustion chamber project from the inner wall of the combustion chamber in a radial direction.

3. The incinerator as claimed in claim 1, wherein the combustion-promoting fluid blast pipes provided within the combustion chamber are disposed on respective sides of a hypothetical polygon inscribed in the combustion chamber when the combustion chamber is viewed in a transverse cross section.

4. The incinerator as claimed in claim 3, wherein the hypothetical polygon inscribed in the combustion chamber is a regular tetragon, which defines the installation position of the combustion-promoting fluid blast pipes.

5. An incinerator comprising:

a cylindrical combustion chamber; and a plurality of combustion-promoting blast pipes each of which is disposed so as to project from an inner wall of the combustion chamber and extend in a vertical direction thereof, wherein the combustion-promoting fluid blast pipes are of a quadruple-pipe construction, each comprising an air-supply pipe, a steam-supply pipe which is provided concentrically outside of the air-supply pipe, a combustible-gas supply pipe provided concentrically outside of the steam-supply pipe and a water pipe which is provided concentrically further outside thereof for protecting the air-supply pipe, the steam-supply pipe and the combustible-gas supply pipe from heat, and a plurality of nozzles are provided on each of the combustion-promoting fluid blast pipes, the nozzles being positioned facing in one circumferential direction of the combustion chamber so that a combustion-promoting fluid blown out from the combustion-promoting fluid blast pipes forms a swirling flow within the combustion chamber; and the air-supply pipes, the steam-supply pipes and the combustible-gas-supply pipes in the combustion-promoting fluid blast pipes are connected respectively to a high-pressure air-supply source, a steam-supply source and a combustible-gas supply source, so that steam and combustible gas can be selectively blown from each of the supply sources air into the combustion chamber as the combustion-promoting fluid via the combustion-promoting fluid blast pipes.

6. The incinerator as claimed in claim 5, wherein the combustion-promoting fluid blast pipes provided within the combustion chamber project from the inner wall of the combustion chamber in a radial direction.

7. The incinerator as claimed in claim 5, wherein the combustion-promoting fluid blast pipes provided within the combustion chamber are disposed on respective sides of a hypothetical polygon inscribed in the combustion chamber when the combustion chamber is viewed in a transverse cross section.

* * * * *